US006121222A

United States Patent [19]

Li et al.

[11] Patent Number: 6,121,222

[45] Date of Patent: Sep. 19, 2000

[54] ANIONIC SURFACTANTS HAVING MULTIPLE HYDROPHOBIC AND HYDROPHILIC GROUPS

[75] Inventors: Ruoxin Li; David James Tracy; Jiang Yang, all of Plainsboro; Manilal S. Dahanayake, Princeton Junction, all of N.J.

[73] Assignee: Rhodia Inc., Cranbury, N.J.

[21] Appl. No.: 08/773,569

[22] Filed: Dec. 27, 1996

[51] Int. Cl.[7] ..... C11D 1/02; C11D 1/10

[52] U.S. Cl. ..... 510/340; 510/351; 510/506; 510/535; 558/20; 558/24; 558/22; 558/26; 558/31; 558/32; 558/34; 558/161; 558/163; 558/165; 558/179; 558/183; 558/186; 558/194; 558/198; 562/101; 562/103; 562/109; 562/110; 562/111; 562/112; 562/582

[58] Field of Search ..... 252/351, 352, 252/356; 510/506, 535, 340, 351; 558/20, 22, 24, 26, 31, 32, 34, 161, 163, 165, 179, 183, 186, 194, 198; 562/101, 103, 109, 110, 111, 112, 582

[56] References Cited

U.S. PATENT DOCUMENTS

| | | | |
|---|---|---|---|
| 2,374,354 | 4/1945 | Kaplan . | |
| 2,524,218 | 10/1950 | Bersworth . | |
| 2,530,147 | 11/1950 | Bersworth . | |
| 2,532,391 | 12/1950 | Bersworth . | |
| 2,568,876 | 9/1951 | White . | |
| 2,574,537 | 11/1951 | DeGroote . | |
| 2,773,068 | 12/1956 | Mannheimer . | |
| 2,781,354 | 2/1957 | Mannheimer . | |
| 2,820,043 | 1/1958 | Rainey . | |
| 2,846,440 | 8/1958 | Hughes . | |
| 3,024,277 | 3/1962 | Hotten . | |
| 3,033,704 | 5/1962 | Sherrill . | |
| 3,095,373 | 6/1963 | Blomfield . | |
| 3,152,080 | 10/1964 | Stuart . | |
| 3,187,003 | 6/1965 | McBride . | |
| 3,244,724 | 4/1966 | Guttmann . | |
| 3,555,041 | 1/1971 | Katz . | |
| 3,578,697 | 5/1971 | Marans . | |
| 3,620,807 | 11/1971 | Murray . | |
| 3,629,104 | 12/1971 | Maddox . | |
| 3,855,156 | 12/1974 | Marumo . | |
| 3,887,476 | 6/1975 | McConnell . | |
| 3,888,797 | 6/1975 | Marumo . | |
| 3,941,817 | 3/1976 | Chakrabarti . | |
| 3,954,647 | 5/1976 | Neros et al. . | |
| 4,511,368 | 4/1985 | Knapp . | |
| 4,705,843 | 11/1987 | Stammann et al. . | |
| 4,917,993 | 4/1990 | Mukunoki et al. . | |
| 4,936,551 | 6/1990 | Behler et al. . | |
| 5,160,450 | 11/1992 | Okahara et al. . | |
| 5,175,220 | 12/1992 | Burba et al. . | |
| 5,250,702 | 10/1993 | Kondo et al. . | |
| 5,288,873 | 2/1994 | Su et al. . | |
| 5,300,235 | 4/1994 | Clewlow et al. . | |
| 5,312,617 | 5/1994 | Unger et al. . | |
| 5,322,630 | 6/1994 | Williams et al. . | |
| 5,487,778 | 1/1996 | Kaiser . | |
| 5,488,180 | 1/1996 | Jenkins et al. . | |
| 5,493,050 | 2/1996 | Varadaraj et al. . | |
| 5,507,863 | 4/1996 | Kaiser . | |
| 5,569,767 | 10/1996 | Uphues et al. . | |
| 5,643,498 | 7/1997 | Li et al. | 252/357 |
| 5,643,864 | 7/1997 | Li et al. | 510/499 |
| 5,656,586 | 8/1997 | Li et al. | 510/535 |
| 5,811,384 | 9/1998 | Tracy et al. | 510/424 |

FOREIGN PATENT DOCUMENTS

| | | |
|---|---|---|
| 432 1022 | 1/1995 | Germany . |
| 4440328 | 5/1996 | Germany . |
| PCT/JP93/00811 | 7/1993 | Japan . |
| PCT/93/25646 | 12/1993 | Japan . |
| PCT/JP/01246 A1 | 1/1996 | Japan . |
| 1078101 | 8/1967 | United Kingdom . |
| 1149140 | 4/1969 | United Kingdom . |
| 1503280 | 3/1978 | United Kingdom . |

OTHER PUBLICATIONS

Rosen, M. Geminis: A New Generation of Surfactants Chembech 30–33 Mar. (1993).

Stapersma, et. al. Hydroxy Alkane Sulfonate, a New Surfactant Based on Olefins JAOCS 69; No. 1, (1992) 39–43.

Herke, et. al. Addition of Bisulfite to α–Olefins: Synthesis of n–Alkane Sulfonates; JAOCS; 69, No. 1 (1992) 47–51.

Jiang, et. al. The Effect of Hydrophobic–Lipophilic Interactions on Chemical Reactivity, J. Am. Chem. Soc. 106 (1984) 7202–7205.

Vold, M. Micellization, Some Properties of Dimers of Na–Octyl Sulfates; J. Colloid and Interface Sci; 135 No. 2 (1990) 520–530.

Menger, et. al. Binding Properties of 1–Pyrenesulfonic Acid in Water. J. Org. Chem.Soc. 52 No. 17 (1987) 3793–98.

Neumann, et. al. The Interaction of Cationic Dyes with Anionic Surfactants in the Premicellar Region. J. Colloid and Interface Sci. 135; No. 1 (1990) 209–217.

Cheng, et. al. Facial Amphiphiles. J. Am. Chem. Soc. 114 No. 18 (1992) 7319–20.

Jaeger, et. al. Double–Chain Surfactants with Two Carboxylate Head Groups that Form Vesicles. Langmuir, 12 No. 8; (1996) 1976–80.

(List continued on next page.)

*Primary Examiner*—Jerry D. Johnson
*Attorney, Agent, or Firm*—Craig M. Bell

[57] ABSTRACT

A novel class of anionic surfactants with improved surfact active properties is comprised of two hydrophilic and two hydrophobic groups represented by the formula:

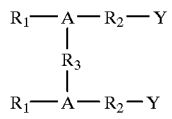

The surfactants exhibit unusually low critical micelle concentration (cmc) and pC-20 values in aqueous media.

20 Claims, No Drawings

OTHER PUBLICATIONS

Okano, et. al. α–Sulfonated Fatty Acid Esters JAOCS 73 No. 1 (1996) 31–37.
Zhu, et. al. Preparation and Properties of Double Chain Surfactants Bearing Two Sulfonate Groups. Jpn. Oil Chem. Soc. 40 vol. 6 (1991) 473–477.
Zhu, et. al. Preparation and Surface Active Properties of New Amphipathic Compounds with Two Phosphate Groups and Two Long Chain Alkyl Groups, JAOCS; 68 No. 4, (1991) 268–71.
Paubert, et. al. Sulphonates Derived from Dimer Acids and Esters. Tenside Surf. Det. 32 No. 1 (1995) 36–44.
Furhop, et. al. Bolaamphiphiles and Monolayer Lipid Membranes; J. Am. Chem. Soc. 108 No. 8 (1986) 1785–91.
Ikeda, et. al. Re–Examination of Aggregation Behavior of Disodium 1,12–Dodecane Disulfate. J. Colloid and Interface Sci 130 No. 1 (1989) 290–91.
Rosen, et. al. Relationship of Structure to Properties of Surfactants: LDS JAOCS 69 No. 1 (1992) 30–33.
Zhu, et. al. Preparation and Surface Active Properties of Amphipathic Compounds with Two Sulfate Groups and Two Lipophile Alkyl Chains. JAOCS 67 No. 7 (1990) 459–463.
Zhu, et. al. Synthesis and Properties of Bis (Sulfonate) Types of Double Chain Surfactants. J. Jpn. Oil Chem. Soc. 42 No. 2 (1993) 86–94.
Zhu, et. al. Preparation and Properties of Glycerol Based Double or Triple Chain Surfactants with Two Hydrophilic Ionic Groups. JAOCS 69; No. 7 (1992) 626–632.
Zhu, et. al. Preparation and Surface Active Properties of New Amphipathic Compounds with Two Phosphate Groups and Two Long–Chain Alkyl Groups. JAOCS 68 No. 4 (1991) 268–271.
Zhu, et. al. Preparation and Properties of Double or Triple Chain Surfactants with Two Sulfonate Groups. JAOCS; 68 No. 7 (1991) 539–543.
Stein, et. al. Synthesis and Aggregation Properties of a New Family of Amphiphiles with Unusual Headgroups. J. Am. Chem. Soc. 114 No. 10; (1992) 3943–3950.
Zhu, et. al. Double–Chain Surfactants with Two Carboxylate Groups and Their Relation to Similar Double–Chain Compounds J. Colloid and Interface Sci. 158 (1993) 40–45.
Okahara, et. al. Surface Active Properties of New Types of Amphiphatic Compounds with Two Hydrophilic Ionic Groups and Two Lipophilic Alkyl Chains J. Jpn. Oil Chem. Soc. 37; No. 9 (1988) 746–747.
Ono, et. al. Preparation and Properties of Bis (Sodium Carboxylate) Types of Cleavable Surfactants Derived from Diethyl Tartrate and Fatty Carbonyl Compounds J. Jpn. Oil Chem. Soc. 42 No. 1 (1993) 10–16.
Gao, et. al. Dynamic Surface Tension of Aqueous Surfactant Solutions.6. JAOCS 71 No. 7 (1994) 771–776.
Masuyama, et. al. Synthesis and Properties of Bis (Taurine) Types of Double Chain Surfactants J. Jpn. Oil Chem. Soc. 41 No. 4 (1992) 13–17.
Kida, et. al. A Facile Synthesis of Polyglycidyl Ethers from Polyols and Epichlorohydrin. Synthesis (May 1993) 487–489.
Tanaka, et. al. Double Chain Surfactant as a New and Useful Micelle Reagent for Electrokinetic Chromatography J. Chromatogr. 648 (1993) 469–473.
Gao, et al. JAOCS; 71; No. 7 (Jul. 1994) 771–776.
Fischer, et al. Tenside Surf. Det. 31 2 (1994) 99–108.
Geminis: A New Generation of Surfactants M. Rosen, Chem. Tech. (Mar., 1993) pp. 30–33.
Menger, et al. JACS; 115 No. 22 (1993) 10083–10090.
Menger, et al. J. Org. Chem. 58; No. 7 (1993) 1909–1916.
Rosen, et al. J. Coll.+ Interface Sci; 157; (1993) 254–259.
M. Rosen, et al. JAOCS 69; No. 1 (Jan. 1992).
Zhu, et al. JAOCS 69; No. 7 (Jul. 1992) 626–632.
Stein, et al. JACS 114; No. 10 (1992) 3943–3950.
Masuyama, et al; Yukagaku 41; No. 4 (1992) 301–305.
Zhu, et al. JAOCS 68; No. 4 (Apr. 1991) 268–271.
Zhu, et al. JAOCS 68; No. 7 (Jul. 1991) 539–543.
Menger, et al. JACS 113 No. 4 (1991) 1451–1452.
Zhu, et al. J. Jpn. Oil Chem. Soc. 40 No. 6; (1991) 473–477.
Zhu, et al. JAOCS 67; No. 7 (Jul. 1990) 459–463.
Ikeda, et al; J. Coll + Interface Sci; 130; No. 1 (Jun. 1989) 290–292.
Okahara, et al. J. Jpn. Oil Chem. Soc. 37; No. 9 (1988) 746–748.
Devinsky, et al; J. Coll + Interface Chem. 105; No. 1 (May 1985) 235–239.
Parreira, et al. JAOCS 56; (Dec. 12, 1978) 1015–1021.
Hidaka, et al; Yukagaku 27; 6 (1978) 370–374 Abstract.
Martell, et al. JACS (Dec. 1950) pp. 5357–5361.

ANIONIC SURFACTANTS HAVING MULTIPLE HYDROPHOBIC AND HYDROPHILIC GROUPS

This invention relates to a novel group of anionic surfactants having at least two hydrophobic moieties and at least two hydrophilic groups per molecule useful as emulsifiers, detergents, dispersants, hydrotropes, wetting agents, corrosion inhibitors and solubilizing agents.

BACKGROUND OF THE INVENTION

Surfactants are well known materials which can be generally described as having a hydrophobic moiety and a hydrophilic group per molecule. A wide variety of these materials are known and are classified as anionic, cationic, nonionic and amphoteric. They are well known to have numerous uses such as emulsifiers, detergents, dispersants and solubilizing agents in the field of cosmetics, textile treatment, industrial and personal cleaning preparations, corrosion inhibitors and the like.

Anionic surfactants carry a negative charge on the hydrophilic portion, usually in the form of a carboxylate, phosphate, sulfate or sulfonate. These surfactants find use in emulsion polymerization as well as in agricultural chemicals, personal care and household products, industrial and institutional cleaners. They function as emulsifiers, cleaners, wetting agents, foaming and frothing agents such as for shampoos, car washes, carpet shampoos, hand dish washing, latex foaming, oil recovery and other industrial uses.

Surfactants generally are compounds having one hydrophilic group and one hydrophobic moiety. Recently, a group of compounds having two hydrophobic moieties and two hydrophilic groups have been introduced. These have become known as "gemini surfactants" in the literature (*Chemtech*, March 1993, pp 30–33), and *J. American Chemical Soc.*, 115, 10083–10090, (1993) and the references cited therein. Since their introduction, cationic and anionic "gemini surfactants" have been disclosed. Other surfactant compounds having two hydrophilic groups and two hydrophobic moieties have been disclosed but not referred to as gemini surfactants.

Sulfate, phosphate, and carboxylate surfactants are currently disclosed in the literature (See JAOCS 67, 459 (1990); JAOCS 68, 268 (1991); JAOCS 68, 539 (1991); and JAOCS 69, 626 (1992). In each case, a secondary hydroxyl is sulfated, carboxylated, or phosphated.

Secondary hydroxyl's phosphate poorly in that phosphoric anhydride leads to olefin production (dehydration) while polyphosphoric acid results in high levels of phosphoric acid and unphosphated material. The present invention results in compounds which are characterized by primary hydroxyl groups which can more efficiently be functionalized.

Similarly, sulfation can also lead to dehydration by-products. Carboxymethylation of secondary hydroxyl groups is also difficult resulting in low yields.

One author [JACS 115, 10,083 (1993) and JACS 113, 1451 (1991)] prepares a phosphate on a primary hydroxyl group. But in these references, it is necessary to utilize mixed alcohols to incorporate a hydrophobe into the molecule. This leads to the production of mixed diphosphate, a necessary outgrowth of using the mixed alcohols. This difficulty is eliminated in the present invention. In addition, high monoalkylphosphates as well as diphosphates can be prepared according to the present invention.

Due to the need for new and more effective and efficient surfactants, as well as the need for mild surfactants which are biologically compatible in an ecologically sensitive environment as well as the need for more effective and efficient surfactants, effort has been made to develop a new class of compounds, which demonstrate improved surface-active properties that are further characterized as mild, and environmentally benign.

SUMMARY OF THE INVENTION

According to the invention, an improved class of anionic surfactants having improved surfactant properties characterized as mild and environmentally benign have been provided comprising compounds of the formula:

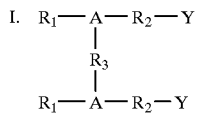

I. $R_1—A(R_3)—R_2—Y$
$R_1—A(R_3)—R_2—Y$ and the salts thereof wherein $R_1$ can independently represent alkyl, hydroxy-substituted or perfluorinated alkyl, or acyl of from about 5 to about 22 carbon atoms; $R_2$ independently represents a $C_1$ to about $C_{10}$ alkylene and the hydroxy-substituted derivatives thereof, a carboxy group [—C(O)O—], a polyether group [$—CH_2—(OR_4)_x—$] wherein $R_4$ represents $C_2$ to about $C_4$ and x is a number from about 1 to 100; $R_3$ independently represents alkylene or alkyl aryl of from $C_1$ to about $C_{10}$ and the hydroxy-substituted derivatives thereof, —S—, a polyether group [$—O(R_4O)_x—$] wherein $R_4$ and x have been hereinbefore defined or $D—R_5—D$ wherein D independently represents —S—, $—SO_2—$, —O—, —S—S—, and $R_5$ represents $C_1$ to about $C_{10}$ alkyl, aryl and the hydroxy-substituted derivatives thereof; A independently represents $—CR_6$ wherein $R_6$ represents $C_1$ to about $C_{20}$ alkyl, or hydrogen and Y independently represents $—SO_3M$, $—OSO_3M$, $OP(O)(OM)_2$ $—CH_2CO_2M$ or M, wherein M represents hydrogen, Na, K, $NH_3$ or organic amine with the proviso that when $R_2$ is a carboxy [—C(O)—O], Y is M.

When compared to the corresponding conventional anionic surfactants, the novel compound of the invention show two unexpected surface active properties; unusually low critical micelle concentration (cmc) and pC-20 values in aqueous media. These properties are a measure of the tendency of the surfactant to form micelles and adsorb at the interface respectfully, and consequently, to reduce surface tension.

More specifically, the compounds of the present invention comprise:

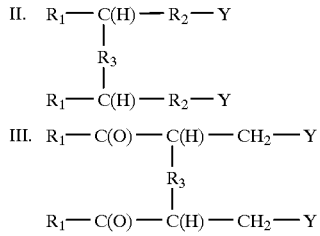

II. $R_1—C(H)(R_3)—R_2—Y$
$R_1—C(H)(R_3)—R_2—Y$

III. $R_1—C(O)—C(H)(R_3)—CH_2—Y$
$R_1—C(O)—C(H)(R_3)—CH_2—Y$ wherein $R_1$, $R_2$, $R_3$, and Y are as defined hereinbefore.

In compound II and III, $R_3$ is preferably $—O—R_4—O$. In compound II, $R_3$ is preferably —S— or $—O—C_6H_4—O—$.

Uniquely, the invention provides anionic surfactants having a primary hydroxyl group which can be readily phosphated, sulfonated, or carboxylated by standard techniques.

In addition to new compounds, the invention also discloses novel synergistic compositions when the compounds of the invention are blended with other surfactants.

DETAILED DESCRIPTION OF THE INVENTION

The compounds of the invention where "A" is carbon can be produced from beta-carbonyl compounds by the reaction of an active hydrogen site with a dihalo compound (See R. C. Fuson and H. R. Snyder Organic Chemistry, 2nd edition, pages 322 and 324, the disclosure of which is incorporated herein by reference.

The compounds of the invention where "A" is carbon can also be produced by condensation of the beta haloacid [See *J. Chem. Soc. Trans.*, 1988 (1905), Chem Ber 24, 2388 (1891)], the disclosure of which is incorporated herein by reference, with nucleophiles such as dihydroxy compounds, e.g., hydroquinones (See R. C. Fuson and H. R. Snyder Organic Chemistry, 2nd edition, page 65, the disclosure of which is incorporated herein by reference.

The compounds of the invention can also be produced by reducing the carboxy groups of the following compounds to alcohols:

(1) First, a fatty acid is converted to an α-bromo fatty ester by the following reaction wherein R' is any alcohol.

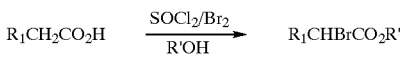

This α-bromo ester is then coupled with a diol in the following manner to produce the bis-ether.

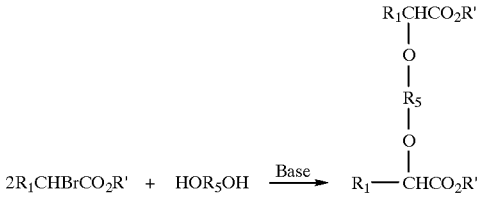

The compounds of the invention can be produced by reducing the carboxy groups to alcohol and derivatizing. Compounds of the invention can also be produced by hydrolysis of the esters.

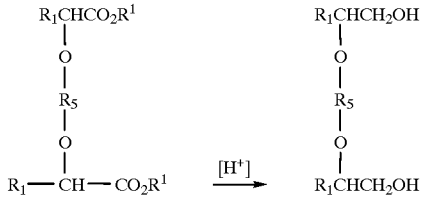

The bis alcohol can be derivatized by either one of two reactions. The alcohol can be phosphated, sulfated or carboxymethylated. The compound can also be ethoxylated,

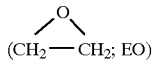

followed by sulfation, phosphation or carboxymethylation if a more hydrophilic species is desired. For example, the reaction can be schematically represented as follows:

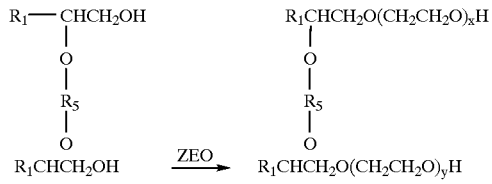

where x + y = Z

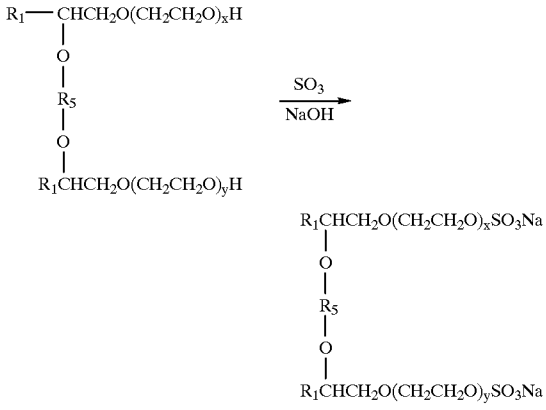

Compounds of the invention can also be produced by hydrolysis of the esters.

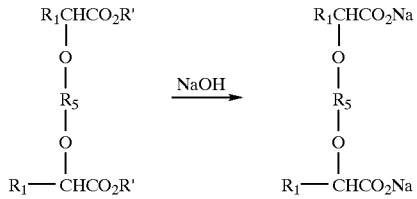

Typical active carbonyl compounds are fatty acids and beta keto esters.

These compounds can be reacted with a sulfating or phosphating agent such as sulfur trioxide, sulfamic acid, chlorosulfonic acid, polyphosphoric acid, or phosphoric anhydride to form the compounds of the invention (Sulfation techniques are discussed in Surfactant Science Series, Vol 7, Part 1, S. Shore and D. Berger, page 135, the disclosure of which is incorporated herein by reference. For phosphating review, see Surfactant Science Series, Vol 7, Part II, E. Jungermann and H. Silbrtman, page 495, the disclosure of which is incorporated herein by reference.)

Since the surfactants of the invention exhibit an extremely low critical micelle concentration (cmc) as compared with conventional surface-active agents because of the presence of two hydrophobic moieties and two hydrophilic groups in their molecule and since they are able to fully reduce surface tension and are highly soluble in water, the surfactants of the invention are extremely effective in aqueous solution at low concentrations. While the surfactants of the invention can be used in any amount needed for the particular application which can be easily determined by a skilled artisan without undue experimentation.

The surfactants of the invention can be used alone as the essential hydrotrope component.

It has also been unexpectedly found that blends of the compounds of the invention with certain conventional well known anionic, nonionic, cationic and amphoteric surfactants provide results beyond that expected and therefore synergistic that can be demonstrated in relation to critical micelle concentration and surface tension reducing ability.

Examples of the nonionic surfactants used herein include fatty acid glycerine esters, sorbitan fatty acid esters, sucrose fatty acid esters, polyglycerine fatty acid esters, higher alcohol ethylene oxide adducts, single long chain polyoxyethylene alkyl ethers, polyoxyethylene alkyl allyl ethers, polyoxyethylene lanolin alcohol, polyoxyethylene fatty acid esters, polyoxyethylene glycerine fatty acid esters, polyoxyethylene propylene glycol fatty acid esters, polyoxyethylene sorbitol fatty acid esters, polyoxyethylene castor oil or hardened castor oil derivatives, polyoxyethylene lanolin derivatives, polyoxyethylene fatty acid amides, polyoxyethylene alkyl amines, an alkylpyrrolidone, glucamides, alkylpolyglucosides, mono- and dialkanol amides, a polyoxyethylene alcohol mono- or diamides and alkylamine oxides. Examples of the anionic surfactants used herein include fatty acid soaps, ether carboxylic acids and salts thereof, alkane sulfonate salts, α-olefin sulfonate salts, sulfonate salts of higher fatty acid esters, higher alcohol sulfate ester salts, fatty alcohol ether sulfates salts, higher alcohol phosphate ester salts, fatty alcohol ether phosphate ester salts, condensates of higher fatty acids and amino acids, and collagen hydrolysate derivatives. Examples of the cationic surfactants used herein include alkyltrimethylammonium salts, dialkyldimethylammonium salts, alkyldimethylbenzylammonium salts, alkylpyridinium salts, alkylisoquinolinium salts, benzethonium chloride, and acylamino acid type cationic surfactants. Examples of the amphoteric surfactants used herein include amino acid, betaine, sultaine, phosphobetaines, imidazoline type amphoteric surfactants, soybean phospholipid, and yolk lecithin.

In addition to the foregoing surfactants, any of commonly used auxiliary additives may be added to the surfactants of the invention or blends thereof with other surfactants as disclosed herein. Such auxiliary additives may be added to the surfactants of the invention on use. Such auxiliary additives may be suitably chosen for a desired composition and generally include inorganic salts such as Glauber salt and common salt, builders, humectants, solubilizing agents, UV absorbers, softeners, chelating agents, and viscosity modifiers.

The anionic surfactants of the invention are extremely mild and non-irritating to both eyes and skin. They also exhibit enhanced wetting speed, greater surface tension reduction, high foaming and foam stabilization properties, low toxicity, and excellent compatibility with other anionic, ionic, and nonionic surfactants. The products of the invention are stable over a wide pH range and are biodegradable. These properties make these surfactants adaptable for use in products ranging from cosmetics to industrial applications and are usable wherever anionic surfactants have found use. These products are particularly useful for non-irritating shampoos, including baby shampoos, body shampoos including bubble baths, bar soaps, bath gels, hair conditioning gels, lotions, skin creams and lotions, make up removal creams and lotions, liquid detergents, dish detergents, and other washing and cosmetic products that contact the skin. The surfactants of the invention can also find use as hard surface cleaners including cars, dishes, toilets, floors, and the like; laundry detergents and soaps, metal working aids and the like.

Examples of the present invention are given below by way of illustration and not by way of limitation. All parts and percents are by weight.

EXAMPLE I

Preparation of Hydroquinone-coupled Gemini Structure

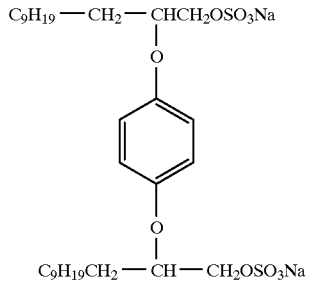

A. Preparation of α-Bromolauric Acid Methyl Ester (1)

Initially, α-Bromolauric acid methyl ester was prepared as follows. Pure lauric acid (100 g, 0.5 mol) was dissolved in thionyl chloride (89 g, 0.75 mol) at 55° C. under nitrogen. A large amount of hydrogen chloride gas was generated. When all the lauric acid was converted to acid chloride and there was no more HCl gas being generated after stirring for 2.5 hours, bromine (89.25 g, 0.65 mol) was slowly added to the solution at room temperature. The reaction mixture was stirred for another 8 hours at 45° C. The reaction was then stopped by evaporating additional bromine at 80° C. by bubbling in nitrogen. The crude product, α-bromolauric acid chloride, was cooled to 0° under nitrogen. Pure methanol was then added very slowly to the acid chloride solution at 0° C. The temperature was not allowed to exceed 15° C. during this process. The final crude product, α-bromolauric acid methyl ester, was washed with water several times. The final product was extracted twice with hexane. The NMR results showed that the product was completely pure. The yield of the reaction was about 98% and may be summarized as follows:

(1)

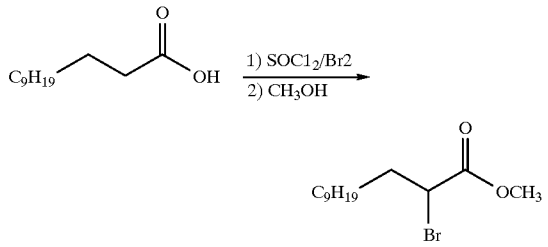

B. Preparation of Hydroquinone Bislauric Acid Methyl Ester (2)

Hydroquinone bislauric acid methyl ester was then prepared as follows: α-Bromolauric acid methyl ester (10.5 g, 0.036 mol) and hydroquinone (1.8 g, 0.016 mol) were stirred in dry dimethyl formamide (DMF) in the presence of sodium carbonate (4.0 g) at 50° C. overnight. The reaction was then stopped by adding acetone to precipitate the salt (sodium bromide) which was separated by filtration. The organic layer was collected and then rotevaporated. In order to remove the excess starting material, the crude product was stripped at 150° C. under reduced pressure for an hour. The final remaining product was immediately analyzed by NMR. The NMR spectrum showed that the crude product (6.5 g)

was at least 95% pure. The reaction may be structurally summarized as follows:

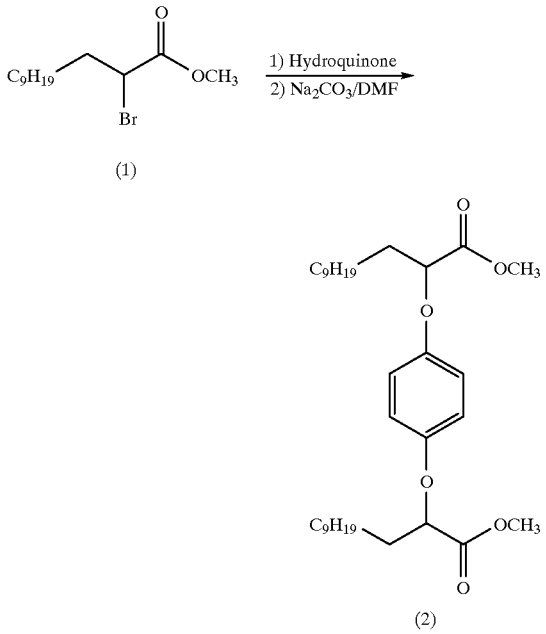

C. Preparation of Hydroquinone Bislauryl Alcohol (3)

The desired nonionic gemini surfactant, hydroquinone bislauryl alcohol was prepared as follows. Hydroquinone bislauric acid methyl ester (5.25 g) was dissolved in dry tetrahydrofuran (THF) at 0° C. Lithium aluminum hydride (LAH) (1.07 g) was added to the solution slowly. A large amount of hydrogen was generated. The reaction temperature was then raised to 25° C. After the reaction was stirred for an hour at this temperature, the reaction was stopped by adding ethanol to deactivate the excess LAH. The solution was mixed with water and then acidified with concentrated HCl. The final product was extracted twice with ether. The crude hydroquinone bislauryl alcohol was dried under vacuum. The product is an oily liquid (4.2 g) whose NMR spectrum agrees with the structure of the expected gemini compound. The reaction can be summarized as follows.

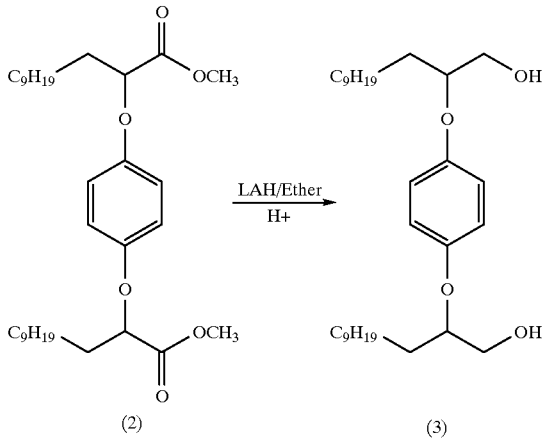

D. Hydroquinone Bislauryl Sodium Sulfate

Hydroquinone bislauryl (1 g) was stirred in dry DMF at 100° C. for 4 minutes. Nitrogen gas was flushed into the solution to remove trace water. Once temperature was then lowered to 50° C., sulfur tiroxide pyridine complex (0.9 g) was added to the reaction mixture. The reaction was stirred overnight at 55° C. TLC (CHC13:Methanol:water=4:1:tract) showed that staring material disappeared and there was new product being generated. The reaction mixture was poured into NaOH ice/water solution.

Crude product was extracted by n-butanol twice. Organic solvent was evaporated by rotevaporation. Solid product was washed with ethanol and then dried under vacuum. NMR results agree with structure of final product.

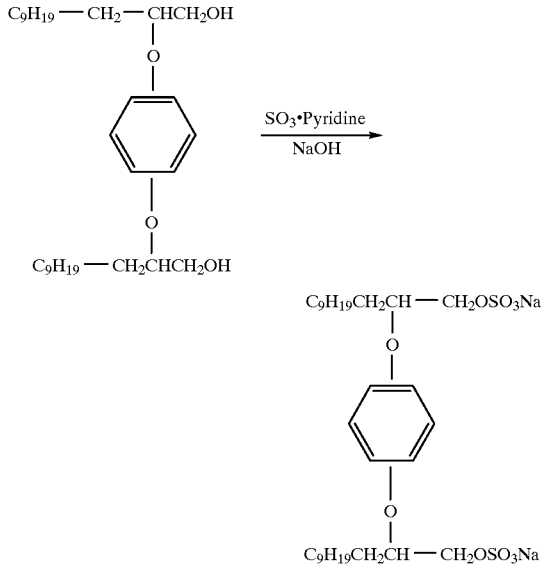

EXAMPLE II

Preparation of Phosphate Ester

A. Hydroquinone Bislauryl Tetra Sodium Diphosphate

Hydroquinone bislauric alcohol (1 g) and triethylamine dissolved in dry THF was added dropwise to a $POCl_3$ ether solution at 0° C. Once it was finished, the reaction temperature was then raised to room temperature and stirred for 2 hours. Reaction was stopped by separating ammonium chloride salt from the organic solution. The organic layer was collected and rotevaporated under reduced pressure. The crude product was then poured into NaOH ice/water solution. The product was obtained by extraction with butanol. NMR results agree with the structure.

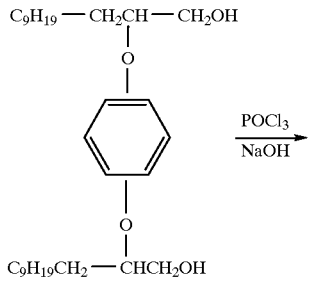

-continued

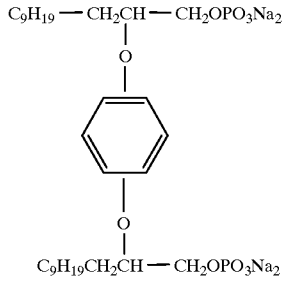

EXAMPLE III

Preparation of Ether Sulfate

A. Preparation of Ethoxylated (20 EO) Hydroquinone Bislauryl Alcohol 478 g (1 mol) of hydroquinone bislauryl alcohol and 0.5 g of potassium hydroxide were added to a 2 gal. autoclave. The autoclave was degassed by pulling vacuum and releasing with nitrogen. The autoclave was heated to 140° C. and ethylene oxide (2 to 3 mols) was added rapidly allowing temperature to exotherm to 150–160° C. The remaining ethylene oxide (880 gm total) was added to a maximum of 53 psig. After 30 minutes of constant pressure and the weighed amount of ethylene oxide is added, the autoclave is cooled to 120° C. and vacuum stripped with a slight nitrogen sparge for 20 minutes. Finally, after cooling, acetic acid was added to lower the system to a pH 7. Analysis by NMR indicated that 20 mols EO were reacted.

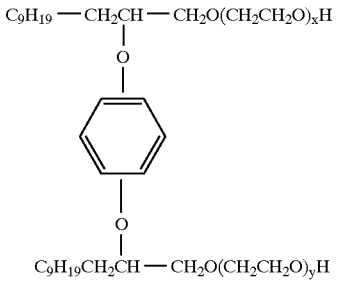

x + y = 20

B. Preparation of Ethoxylated (20 EO) Hydroquinone Bislauryl Alcohol Sulfate

To 135 g of ethoxylate (from part A) is charged to a flask equipped with thermometer stirrer nitrogen sparge and heated to 110° C. Sulfamic acid (21.5 g) is slowly added. The reaction is heated to 115° C. and held 4 hours to complete the reaction. The reaction is monitored by thin layer chromatography.

EXAMPLE IV

Preparation of Dithioether-Coupled Gemini

Another nonionic gemini surfactant, ethoxylated ethylene dithio-bislauryl alcohol was prepared. First, the α-bromolauric acid methyl ester was prepared as in Example I.

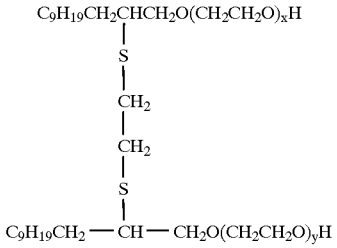

wherein x + y = 16

A. Preparation of Dithio-Coupled Ester

α-bromolauric acid methyl ester (15 g), ethylenedithiol (1.9 ml) and sodium carbonate (4.9 g) were stirred together in dry DMF. After the reaction was carried out under argon at 60° C. for 22 hours, it was stopped by cooling down to room temperature. The inorganic salt was separated by filtration. The organic portion was collected. DMF solvent and the excess amount of α-bromolauric acid methyl ester were distilled out at 190° C. (external temperature) under vacuum. This took about 30 minutes. The remaining material, a yellow liquid, was immediately analyzed by NMR. Both $^{1}$H-NMR and $^{13}$C-NMR spectra agreed with the expected structure of the final product. The reaction scheme may be summarized as follows.

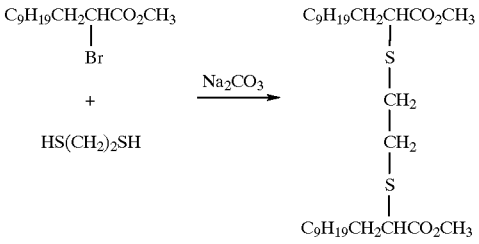

B. Preparation of Ethylenedithio-Bislauryl Alcohol

Ethylenedithio-bislauryl alcohol was prepared as the final intermediate as ethylenedithio-bislauric acid methyl ester (8 g) was dissolved in dry THF at 0° C. (ice bath). Lithium aluminum hydride (1.16 g) was added to the flask slowly. Hydrogen was generated, and the reaction temperature was gradually raised to 30° C. After stirring for 4 hours, the reaction was quenched by pouring the solution thus formed into ice water. The aqueous solution was neutralized by adding concentrated HCl, and the crude product was then extracted with ethyl acetate three times. After evaporating the solvents, the compound (7.0 gm) was dried under vacuum and analyzed by NMR. NMR data agrees with the expected structure of the final product as set forth in the reaction summary below.

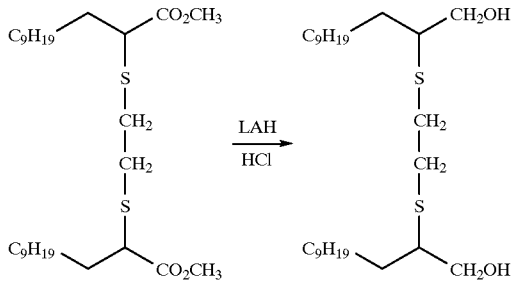

C. Preparation of Dithio-Coupled Gemini III

Finally, ethoxylated ethylenedithio-bislauryl alcohol was prepared by mixing potassium hydroxide flakes (0.545 g) in melted ethylenedithio-bislauryl alcohol (462 g) in a two-gallon autoclave under nitrogen. The reactor was then degassed and the autoclave heated to 140° C. Ethylene oxide (2.0–3.0 mols) was added quickly allowing for reaction kick. Additional ethylene oxide (704 gm total) was added at 150–160° C. and 90 psig. for 30 minutes. When the pressure remained constant, the reaction was cooled to 120° C. and vacuum stripped with a slight nitrogen sparge for 20 minutes. Finally, acetic acid was added to a pH of 7.0 in order to neutralize the potassium hydroxide. NMR analysis indicated the reaction produced 16 mols of ethoxylated ethylenedithio-bislauryl alcohol which had a cloud point (1.0% in $H_2O$) of 69° C. The reaction scheme may be structurally summarized as follows.

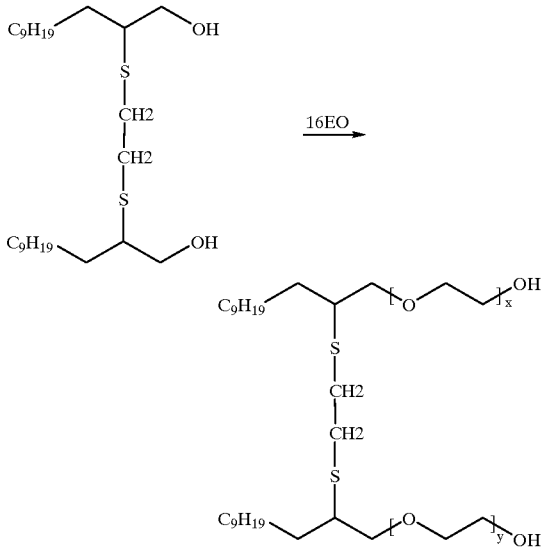

III. x + y = 16

D. Preparation of Ethoxylated (16 EO) Ethylenedithiol Bislauryl Alcohol Sodium Sulfate Ethoxylated (16 EO) ethylene bislauryl alcohol (33.66 g) was stirred in dry DMF for one hour at 110° C. with a nitrogen purge into the solution to remove trace water. The reaction temperature was then lowered to 50° C., and sulfur trioxide pyridine complex (16 g) in dry DMF was slowly added to the solution. The reaction was stirred for 7 hours at 55° C. The solution became clear. The reaction was stopped by pouring into NaOH and ice water solution. After this solution was stirred for 40 minutes, the crude product was extracted by n-butanol twice. Butanol was evaporated under reduced pressure. The remaining product was again dissolved in ethanol. Insoluble inorganic material was removed by filtration. The ethanol layer was collected, rotevaporated and dried under vacuum. The structure of the final product was confirmed by NMR analysis.

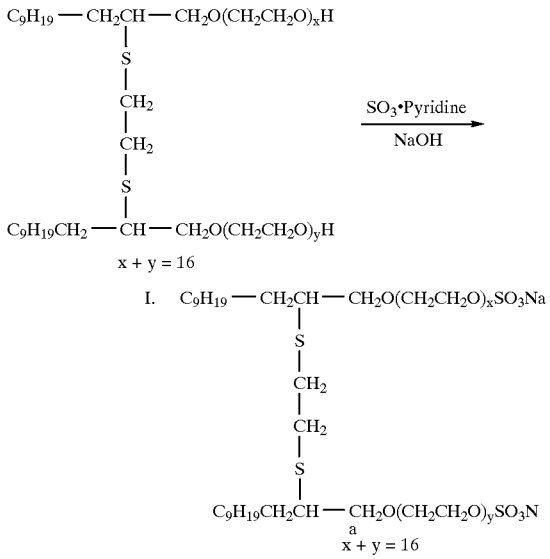

EXAMPLE V

A. Preparation of Ethoxylated (16 EO) Ethylenedithiol Bislauryl Alcohol Phosphoric Acid Phosphorus oxychloride (15 g) was mixed with hexane and dry THF. A solution of ethoxylated (16 EO) ethylenedithiol bislauryl alcohol (23.53 g, 0.052 mol) and triethylamine (5.4 g, 0.0534 mol) in a mixture of THF and ether was added dropwise to the phosphorus oxychloride solution at 0° C. White ammonium salt was generated right away. After stirring for 2 hours, the reaction was stopped. Inorganic salt and amine hydrochloride was separated by filtration. The organic layer was collected and rotevaporated under reduced pressure. This intermediate product was then poured into ice water solution. The solution was stirred for an hour. The crude final product was extracted by n-butanol twice. Organic solvent was rotevaporated. The final product was obtained by vacuum stripping. The NMR results agree with structure of the product.

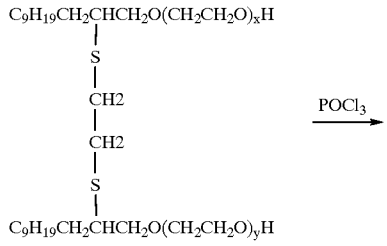

-continued

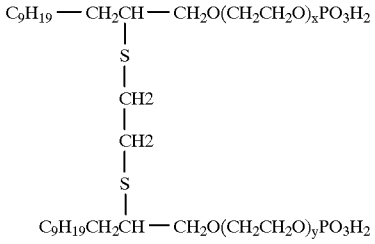

x + y = 16

EXAMPLE VI

A. Preparation of Hydroquinone Bislauric Acid Sodium Salt

Hydroquinone bislauric acid methyl ester prepared in Example 1 (2.8 g) was stirred in sodium hydroxide ethanol/water solution at room temperature for 12 hours. At first, the solution was cloudy. By the end of the reaction, the solution was clear. The crude product was extracted with n-butanol twice. After the solvent was rotevaporated, the remaining material was washed with ethanol. The white solid material was collected by filtration. NMR results showed that the material is the desired product.

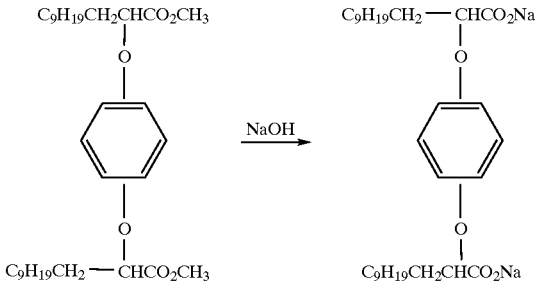

EXAMPLE VII

A. Preparation of Ethylenedithiobislauric Acid Sodium Salt

Ethylenedithiol bislauric acid methyl ester (prepared in Example IV) was stirred in a mixture of isopropanol and water solution. A small amount of sodium hydroxide was added. The solution was cloudy but soon became clear after stirring for 20 minutes. The reaction was allowed to stir for 12 hours at room temperature, and then stopped by extracting with n-butanol twice. The organic solvent was rotevaporated under reduced pressure, and the solid material was collected. This material was washed with cold ethanol first and then redissolved into methanol to remove trace inorganic salt by filtration. The final white powder product was obtained by evaporating methanol under reduced pressure. Both $^{1}H$ and $^{13}C$-NMR agree with the structure of product.

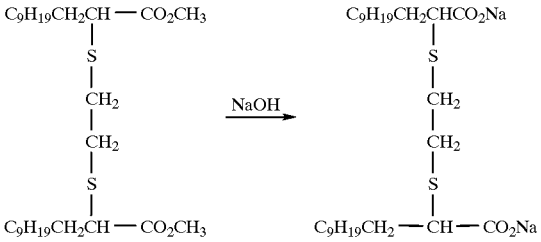

EXAMPLE VIII

A. Surface Activity

The surfactants of the invention were measured for critical micelle concentration and their ability to reduce surface tension.

The test methods utilized are described as follows:

Critical Micelle Concentration (cmc)

Aqueous solutions of the surfactant were prepared at varying concentrations. The surface tension at 20° C. was calculated by the Wilhelmy Plate Method and plotted versus concentration. The critical micelle concentration was determined as the value at which the slope of the line changed abruptly.

The surface tension reducing ability was determined from the surface tension at the critical micelle concentration.

Surface tension measurements were made for each of the referenced surfactants, using a Kruss K-12 Tensiometer (plate method). Each experiment was carried out as follows.

Distilled water solutions at different concentration were prepared for each of the test surfactants in 100 mL containers (volumetric flasks) The mixtures were stirred until homogeneous solutions were obtained. The surface tensions of these solutions were then measured.

From the surface tension data, the area/molecule (area) at the interface and efficiency of adsorption were computed by use of the appropriate Gibb's Adsorption Equation:

$$\rho = \frac{-d\gamma}{d\log C_T} \Big/ 2.303\,RT$$

where

ρ=surface excess concentration (mol/cm$^2$)

dγ=change in surface or interfacial tension of the solvent (dyne·cm$^{-1}$)

R=8.31 * 10$^7$ erg·mol$^{-1}$·°K$^{-1}$

C=molar concentration of solution

T=absolute temperature (°K)

The data generated by the examples of this invention are tabulated.

| | Surface Tension at cmc dyne/cm | cmc (M) | Area/molecule Å$^2$ |
|---|---|---|---|
| Example I | 30.6 | $4.0 \times 10^{-5}$ | 98.8 |
| Example VI | 34.0 | $1.4 \times 10^{-5}$ | 78 |
| Example VII | 31.0 | $2.8 \times 10^{-5}$ | 68.6 |
| $C_{12}H_{25}SO_4Na$ (Conventional) | 32.5 | $1.5 \times 10^{-3}$ | 41 |
| $C_{11}H_{23}CO_2Na$ (Conventional) | — | $2.44 \times 10^{-3}$ | 47 |

Comparison of the cmc of Example 1 to the conventional single chain sodium laurylsulfate indicates a 100 times greater activity. Similarly, comparison of Examples VI and VII ($1.4\times10^{-5}$; $2.8\times10^{-5}$) to the corresponding conventional (single chain) surfactant ($C_{11}H_{23}CO_2Na$; $2.4\times10^{-3}$) indicates about 100 times greater surface activity.

What we claim is:

1. Anionic surfactants comprising compounds of the formula:

I. $R_1—A(R_1)—R_2—Y$
$R_3—A—R_2—Y$ and the salts thereof wherein $R_1$ can independently represent an alkyl, hydroxy-substituted or perfluorinated alkyl, or acyl of from about 5 to about 22 carbon atoms; $R_2$ independently represents a $C_1$ to about $C_{10}$ alkylene and the hydroxy-substituted derivatives thereof, a carboxy group (—C(O)O—), a polyether group (—$CH_2$—$(OR_4)_x$—) wherein $R_4$ represents a $C_2$ to about $C_4$ alkyl and x is a number from about 1 to 100; $R_3$ independently represents —S—, a polyether group (—O$(R_4O)_x$—) wherein $R_4$ and x have been hereinbefore defined or D—$R_5$—D wherein D independently represents —S—, —$SO_2$—, —O—, —S—S—, and $R_5$ represents a $C_1$ to about $C_{10}$ alkyl, aryl and the hydroxy-substituted derivatives thereof; A independently represents —$CR_6$ wherein $R_6$ represents a $C_1$ to about $C_{20}$ alkyl, or hydrogen and Y independently represents —$SO_3M$, —$OSO_3M$, $OP(O)(OM)_2$—$CH_2CO_2M$ or M, wherein M represents hydrogen, Na, K, $NH_3$ or an organic amine with the proviso that when $R_2$ is a carboxy (—C(O)—O), Y is M.

2. The surfactant of claim 1, wherein $R_1$ represents alkyl of from about 6 to about 18 carbons atoms.

3. The surfactant of claim 2, wherein $R_2$ represents a lower alkylene of from 1 to about 4 carbon atoms.

4. The surfactant of claim 3, wherein Y is sulfate, phosphate, carboxylate and the salts thereof.

5. The surfactant of claim 4, wherein said salt in Formula I is selected from the group consisting of an alkali metal salt, an ammonium salt, and an organic base salt.

6. The surfactant of claim 5, wherein said organic base salt is selected from the group consisting of monoethanolamine, diethanolamine, triethanolamine, triethylamine, trimethylamine and N-hydroxyethyl morpholine.

7. A surfactant composition of claim 6, further comprising a second surfactant selected from the group consisting of an anionic, nonionic, cationic, and amphoteric surfactant.

8. A surfactant composition of claim 7, wherein said nonionic surfactant is selected from the group consisting of a fatty acid glycerine ester, a sorbitan fatty acid ester, a sucrose fatty acid ester, a polyglycerine fatty acid ester, a higher alcohol ethylene oxide adduct, a single long chain polyoxyethylene alkyl ether, a polyoxyethylene alkyl allyl ether, a polyoxethylene lanolin alcohol, a polyoxyethylene fatty acid ester, a polyoxyethylene glycerine fatty acid, a polyoxyethylene propylene glycol fatty acid ester, a polyoxyethylene sorbitol fatty acid ester, a polyoxyethylene castor oil or hardened castor oil derivative, a polyoxyethylene lanolin derivative, a polyoxethylene fatty acid amide, a polyoxyethylene alkyl amine, an alkyl pyrrolidone, glucamides, alkylpolyglucosides, a mono or dialkanol amide, a polyoxyethylene alcohol mono or diamide, and an alkylamine oxide.

9. A cleaning composition comprised of a blend of surfactants of claim 8.

10. A surfactant composition of claim 7, wherein said anionic surfactant is selected from the group consisting of a fatty acid soap, an ether carboxylic acid and salt thereof, an alkane sulfonate salt, an α-olefin sulfonate salt, a sulfonate salt of a higher fatty acid ester, a higher alcohol sulfate ester salt, fatty alcohol ether sulfate salts, a higher alcohol phosphate ester salt, a fatty alcohol ether phosphate ester salt, a condensate of higher fatty acids and amino acids, and a collagen hydrolysate derivative.

11. A cleaning composition comprised of a blend of surfactants of claim 10.

12. A surfactant composition of claim 7, wherein said cationic surfactant is selected from the group consisting of an alkyltrimethylammonium salt, a dialkyldimethylammonium salt, an alkyl-dimethyl-benzylammonium salt, an alkylpyridinium salt, an alkylisoquinolinium salt, benzethonium chloride, and an acylamino acid type cationic surfactant.

13. A cleaning composition comprised of a blend of surfactants of claim 12.

14. A surfactant composition of claim 7, wherein said amphoteric surfactant is selected from the group consisting of an amino acid, betaine, sultaine, phosphobetaine, an imidazoline-type amphoteric surfactant, soybean phospholipid, and yolk lecithin.

15. A cleaning composition comprised of a blend of surfactants of claim 14.

16. A cleaning composition comprised of one or more of the surfactants of claim 1.

17. Anionic surfactants comprising compounds of the formula:

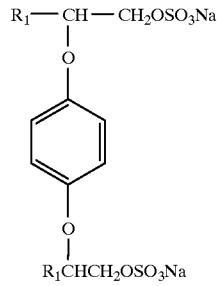

wherein $R_1$ can independently represent alkyl, hydroxy-substituted or perfluorinated alkyl, or acyl of from about 5 to about 22 carbon atoms.

18. A cleaning composition comprising one or more of the surfactants of claim 17.

19. Anionic surfactants comprising compounds of the formula:

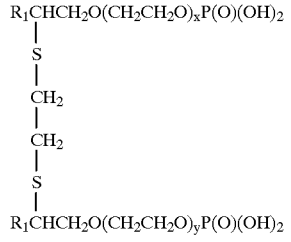

wherein $R_1$ can independently represent alkyl, hydroxy-substituted or perfluorinated alkyl, or acyl of from about 5 to about 22 carbon atoms and x and y are whole integers of from about 1 to 10 and x+y=16.

20. A cleaning composition comprising one or more surfactants of claim 19.

* * * * *